US009349315B2

(12) United States Patent
Jeong

(10) Patent No.: US 9,349,315 B2
(45) Date of Patent: May 24, 2016

(54) ORGANIC LIGHT-EMITTING DISPLAY DEVICE TO COMPENSATE PIXEL THRESHOLD VOLTAGE

(71) Applicant: LG Display Co., Ltd., Chicago, IL (US)

(72) Inventor: Ui Taek Jeong, Seoul (KR)

(73) Assignee: LG Display Co., Ltd., Seoul (KR)

( * ) Notice: Subject to any disclaimer, the term of this patent is extended or adjusted under 35 U.S.C. 154(b) by 289 days.

(21) Appl. No.: 13/644,881

(22) Filed: Oct. 4, 2012

(65) Prior Publication Data

US 2013/0083001 A1 Apr. 4, 2013

(30) Foreign Application Priority Data

Oct. 4, 2011 (KR) ..... 10-2011-0100875

(51) Int. Cl.
*G09G 3/30* (2006.01)
*G09G 3/32* (2016.01)

(52) U.S. Cl.
CPC ..... *G09G 3/3233* (2013.01); *G09G 3/30* (2013.01); *G09G 3/3208* (2013.01); *G09G 2300/0814* (2013.01); *G09G 2320/0295* (2013.01); *G09G 2320/043* (2013.01)

(58) Field of Classification Search
CPC ..... G09G 3/3208; G09G 3/30; G09G 3/3233; G09G 2320/045; G09G 3/042
USPC ..... 345/82, 76
See application file for complete search history.

(56) References Cited

U.S. PATENT DOCUMENTS 8,115,707 B2 * 2/2012 Nathan et al. ..... 345/78
8,242,989 B2 8/2012 Kwon
8,836,691 B2 * 9/2014 Ryu ..... G09G 3/3233 345/214
9,064,457 B2 6/2015 Kawabe
2009/0051628 A1 * 2/2009 Kwon ..... 345/77
2009/0140959 A1 * 6/2009 Nam et al. ..... 345/76
2011/0122119 A1 * 5/2011 Bae et al. ..... 345/211
2011/0157134 A1 * 6/2011 Ogura ..... G09G 3/20 345/211
2011/0205250 A1 * 8/2011 Yoo et al. ..... 345/690
2011/0216056 A1 * 9/2011 Yoo et al. ..... 345/212
2012/0293478 A1 * 11/2012 Chaji et al. ..... 345/212

FOREIGN PATENT DOCUMENTS

CN 101488319 A 7/2009
JP 2008-504576 A 2/2008
JP 2011-081267 A 4/2011

(Continued)

OTHER PUBLICATIONS

Office Action issued in Chinese Patent Application No. 201210369612.9, mailed Aug. 4, 2014, 8 pages.

(Continued)

*Primary Examiner* — Chanh Nguyen
*Assistant Examiner* — Yuzhen Shen
(74) *Attorney, Agent, or Firm* — Brinks Gilson & Lione

(57) ABSTRACT

An organic light-emitting display device includes: an organic light-emitting panel defined into a plurality of pixel regions which each includes a drive transistor configured to drive an organic light emission element and a load capacitor configured to charge a threshold voltage of the drive transistor; and a controller configured to calculate an offset information on the basis of the threshold voltage and derive a second image signal by reflecting the offset information to a first image signal.

7 Claims, 8 Drawing Sheets

(56) References Cited

FOREIGN PATENT DOCUMENTS

| | | | |
|---|---|---|---|
| KR | 10-2006-0112995 | A | 11/2006 |
| KR | 10-2011-0096877 | A | 8/2011 |

OTHER PUBLICATIONS

Notice of Allowance dated May 28, 2015 for corresponding Korean Application No. Oct. 2011-0100875, 6 pages.

* cited by examiner

ORGANIC LIGHT-EMITTING DISPLAY DEVICE TO COMPENSATE PIXEL THRESHOLD VOLTAGE

The present application claims priority under 35 U.S.C. §119(a) of Korean Patent Application No. 10-2011-0100875 filed on Oct. 4, 2011, which is hereby incorporated by reference in its entirety.

BACKGROUND

1. Field of the Invention

Embodiments of the disclosure relate to an organic light-emitting display device.

2. Discussion of the Related Art

Devices for displaying information are being widely developed. The display devices include liquid crystal display (LCD) devices, organic light-emitting display (OLED) devices, electrophoresis display devices, field emission display (FED) devices, and plasma display devices.

Among these display devices, OLED devices have the desirable features of lower power consumption, wider viewing angle, lighter weight and higher brightness compared to LCD devices. As such, the OLED device is considered to be next generation display device.

Thin film transistors used in the organic light-emitting display device can be driven in high speed. To this end, the thin film transistors increase carrier mobility using a semiconductor layer, which is formed from polysilicon. Polysilicon can be derived from amorphous silicon through a crystallizing process.

A laser scanning mode is widely used in the crystallizing process. During such a crystallizing process, the power of a laser beam can be unstable. As such, the thin film transistors formed on the scanned line, which is scanned by the laser beam, can have different threshold voltages from each other. This can cause image quality to be non-uniform between pixel regions.

To address this matter, a technology detecting the threshold voltages of pixel regions and compensating for the threshold voltages of thin film transistors had been proposed.

However, in order to realize such threshold voltage compensation, not only must a transistor for detecting the threshold voltage be added into the pixel region but also signal lines used for controlling the thin film transistors must be added. Thus, the pixel region becomes complex, and an aperture of the pixel region decreases.

BRIEF SUMMARY

An organic light-emitting display device includes: an organic light-emitting panel defined into a plurality of pixel regions, the pixel region including a drive transistor configured to drive an organic light emission element and a load capacitor configured to charge a threshold voltage of the drive transistor; and a controller configured to calculate an offset information on the basis of the threshold voltage and derive a second image signal by reflecting the offset information to a first image signal.

Other systems, methods, features and advantages will be, or will become, apparent to one with skill in the art upon examination of the following figures and detailed description. It is intended that all such additional systems, methods, features and advantages be included within this description, be within the scope of the present disclosure, and be protected by the following claims. Nothing in this section should be taken as a limitation on those claims. Further aspects and advantages are discussed below in conjunction with the embodiments. It is to be understood that both the foregoing general description and the following detailed description of the present disclosure are exemplary and explanatory and are intended to provide further explanation of the disclosure as claimed.

BRIEF DESCRIPTION OF THE DRAWINGS

The accompanying drawings, which are included to provide a further understanding of the embodiments and are incorporated herein and constitute a part of this application, illustrate embodiment(s) of the present disclosure and together with the description serve to explain the disclosure. In the drawings.

DETAILED DESCRIPTION OF THE DRAWINGS AND THE PRESENTLY PREFERRED EMBODIMENTS

Figure 1:
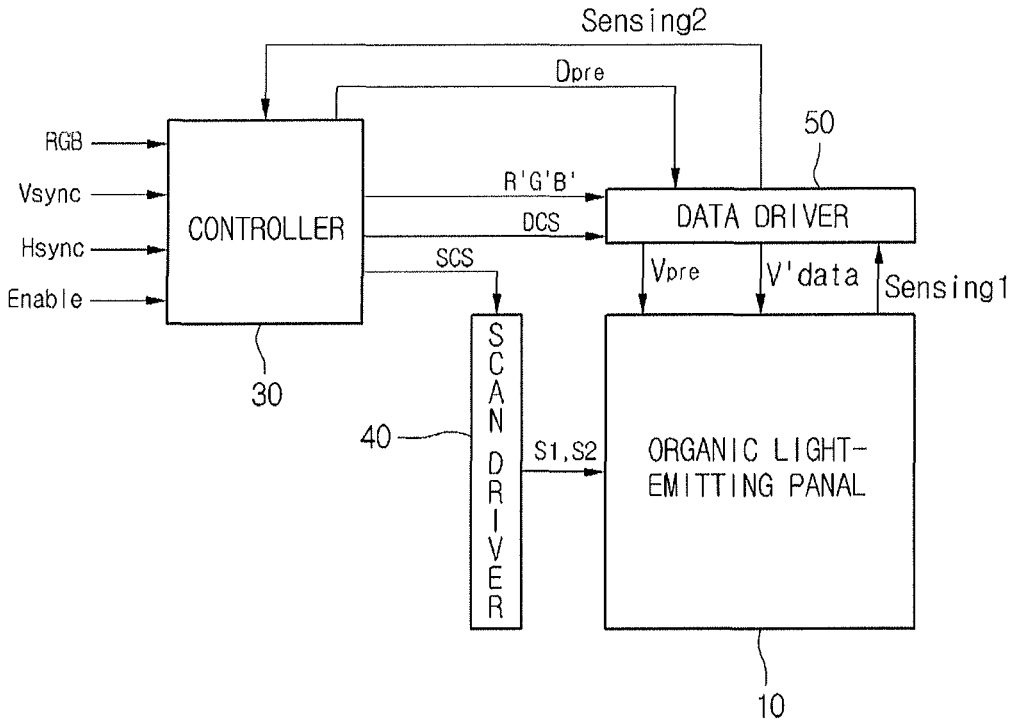
FIG. 1 is a block diagram showing an organic light-emitting display device according to an embodiment of the present disclosure.

In the present disclosure, it will be understood that when an element, such as a substrate, a layer, a region, a film, or an electrode, is referred to as being formed "on" or "under" another element in the embodiments, it may be directly on or under the other element, or intervening elements (indirectly) may be present. The term "on" or "under" of an element will be determined based on the drawings.

Reference will now be made in detail to the present embodiments, examples of which are illustrated in the accompanying drawings. In the drawings, the sizes and thicknesses of elements can be exaggerated, omitted or simplified for clarity and convenience of explanation, but they do not mean the practical sizes of elements.

FIG. 1 is a block diagram showing an organic light-emitting display device according to an embodiment of the present disclosure.

Referring to FIG. 1, the organic light-emitting display device according to an embodiment of the present disclosure can include an organic light-emitting panel 10, a controller 30, a scan driver 40 and a data driver 50.

The scan driver 40 can apply first and second scan signals S1 and S2 to the organic light-emitting panel 10.

The data driver 50 can apply data voltages to the organic light-emitting panel 10.

Figure 2:
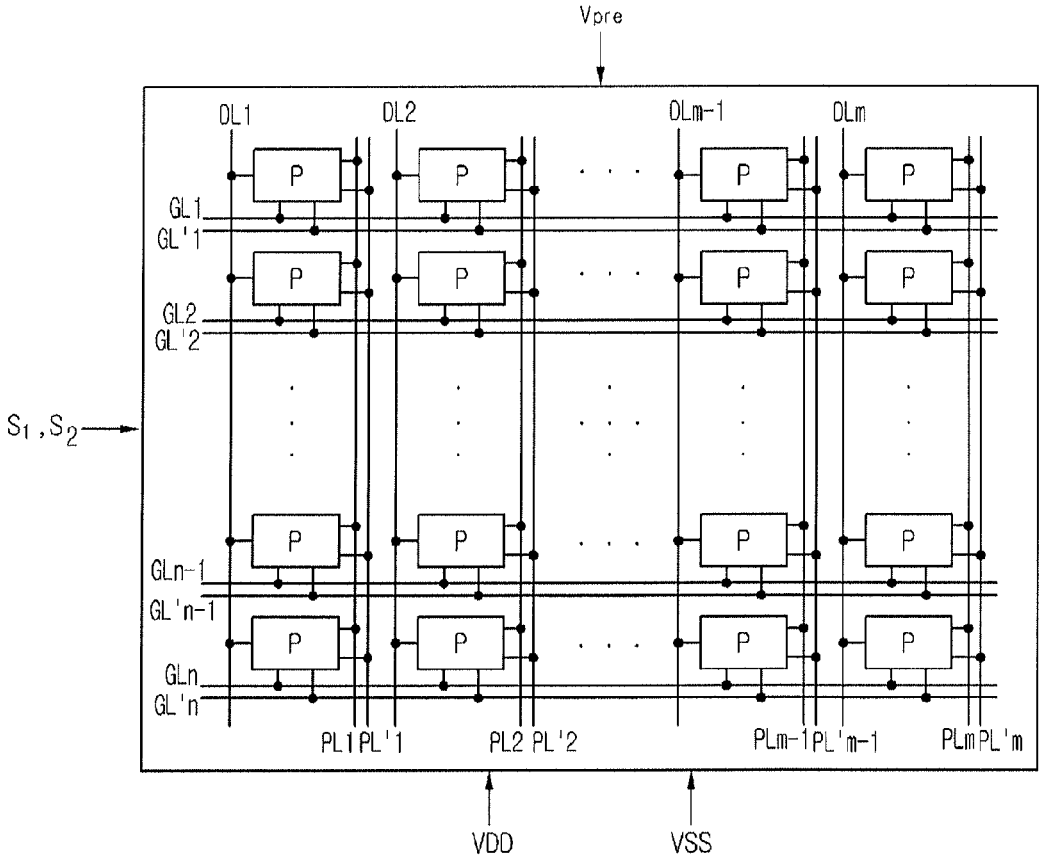
FIG. 2 is a circuit diagram showing an organic light-emitting panel of FIG. 1.

The organic light-emitting panel 10 can include a plurality of scan lines GL1~GLn and GL'1~GL'n, a plurality of data lines DL1~DLm, a plurality of first power lines PL1~PLm and a plurality of second power lines PL'1~PL'm, as shown in FIG. 2.

Although it is not shown in the drawings, the organic light-emitting panel 10 may further include a plurality of signal lines.

A plurality of pixel regions P can be defined by the scan lines GL1~GLn and data lines DL1~DLm which are crossed with each other. These pixel regions P can be arranged in a matrix shape. Each of the pixel regions P can be electrically connected to the first scan line GL1~GLn, the second scan line GL'1~GL'n, the data line DL1~DLm, the first power line PL1PLm, and the second power line PL'1~PL'm.

For example, the first and second scan line GL1~GLn and GL'1~GL'n can be electrically connected to the plurality of pixel regions P arranged in a horizontal direction. The data line DL1~DLm can be electrically connected to the plurality of pixel regions P arranged in a vertical direction.

Such a pixel region P can receive first and second scan signals S1 and S2, a pre-charge data voltage Vpre, a data voltage Vdata and first and second power supply voltages VDD and VSS. More specifically, the first and second scan signals S1 and S2 can be applied to the pixel region P through the first and second scan lines GL1~GLn and GL'1~GL'n. The pre-charge data voltage Vpre and the data voltage Vdata can be applied to the pixel region P via the data line DL1~DLm. The first and second power supply voltages VDD and VSS can be applied to the pixel region P each through the first and second power supply lines PL1~PLm and PL'1~PL'm.

Meanwhile, sensing information Sensing1 including a threshold voltage Vth and mobility μ of the pixel region P can be obtained from the pixel region P. The sensing information Sensing1 may be applied from the pixel region P to the exterior, for example the data driver 50 of FIG. 1, through the data line DL1~DLm.

First through third transistors T1~T3, a storage capacitor Cst, a load capacitor Cload, and an organic light emission element OLED can be formed in each of the pixel regions P, but it is not limited to this. In other words, the number of transistors and a connection structure therebetween within each of the pixel regions can be modified in a variety of shapes by a designer. As such, this embodiment can be applied to every circuit structure of the pixel region which can be modified by designers.

The first and second transistors T1 and T2 can become switching transistors used to transfer signals. The third transistor T3 can become a drive transistor used to generate a drive current for driving the organic light emission element OLED.

The storage capacitor Cst can have a function to maintain the data voltage Vdata for one frame period.

The load capacitor Cload can charge a pre-charge data voltage Vpre applied from the exterior and apply the charged pre-charge data voltage Vpre to the organic light emission element OLED. The load capacitor Cload can provide the sensing information Sensing1, which includes the threshold voltage Vth and the mobility p, to the exterior.

The organic light emission element OLED is configured to emit light. The organic light emission element OLED can emit light having brightness which varies with intensity of the drive current. Such an organic light emission element OLED can include a red organic light emission element OLED configured to emit red light, a green organic light emission element OLED configured to emit green light, and a blue organic light emission element OLED configured to emit blue light.

The first through third transistors T1~T3 can become PMOS-type thin film transistors, but it is not limited to this. The first through third transistors T1~T3 can be turned-on by a signal of a low level and turned-off by a signal of a high level.

The high level can become a ground voltage or a voltage approaching the ground voltage. The low level can become a lower voltage than the ground voltage. For example, the low and high levels can be −10V and 0V, respectively, but it is not limited to this.

The first power supply voltage VDD can become a high level signal. The second power supply voltage VSS can become a low level signal. The first and second power supply voltages VDD and VSS can be DC (Direct Current) voltages maintaining fixed levels, respectively.

Figure 3:
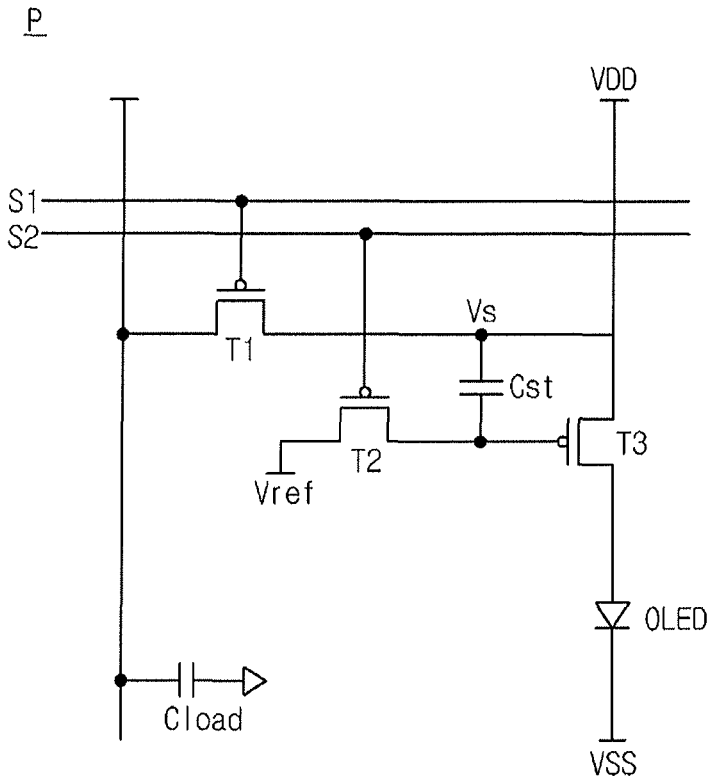
FIG. 3 is a circuit diagram showing a pixel region in FIG. 2.

FIG. 3 shows the first and second scan lines GL and GL'. Also, it is shown that first and second scan signals S1 and S2 are applied to the first and second scan lines GL and GL', respectively.

However, the first and scan signals S1 and S2 can have substantially the same waveform. As such, the same scan signal can be applied to the first and second transistors T1 and T2. In accordance therewith, only one scan line GL or GL' can be provided to the pixel region, and a single scan signal can be applied to the first and second transistors T1 and T2 through the single scan line GL or GL'.

The load capacitor Cload can be connected to the data line DL. As such, the load capacitor Cload can charge the pre-charge data voltage Vpre and the data voltage Vdata, which are applied from the data line DL. Additionally, the load capacitor Cload can charge the sensing information Sensing1 including the threshold voltage Vth when the sensing information Sensing1 is detected. The sensing information Sensing1 charged in the load capacitor Cload can be provided to the exterior through the data line DL.

A gate electrode of the first transistor T1 can be connected to the first scan line GL to which the first scan signal S1 is applied. A source electrode of the first transistor T1 can be connected to the data line DL. A drain electrode of the first transistor T1 can be connected to a first node, which is used for generating a source voltage of the third transistor T3.

Such a first transistor T1 can be turned-on by the first scan signal S1 of a low level, which is applied to the first scan line GL, and enable the pre-charge data voltage Vpre or the data voltage V'data the data line DL to be charged into the first node.

The first node can be commonly connected to the drain electrode of the first transistor T1, the storage capacitor Cst, a source electrode of the third transistor T3, and the first, power line PL.

A gate electrode of the second transistor T2 can be connected to the second scan line GL' to which the second scan signal S2 is applied. A source electrode of the second transistor T2 can be connected to the reference voltage line to which a reference voltage Vref is applied. A drain electrode of the second transistor T2 can be connected to a second node.

Such a second transistor T2 can be turned-on by the second scan signal S2 of the low level, which is applied to the second scan line GL', and enable the second node to be discharged to the reference voltage Vref.

The second node can be commonly connected to the drain electrode of the second transistor T2 and a gate electrode of the third transistor T3.

The storage capacitor Cst can be connected between the first and second nodes. The storage capacitor Cst can enable the voltage at the second node to be varied with the variation of a voltage Vs at the first node.

The gate electrode of the third transistor T3 can be connected to the second node. The source electrode of the third transistor T3 can be connected to the first node and the first power line PL.

The third transistor T3 can generate a drive current varying along the voltage on the second node. The third transistor T3 can apply the drive current to the organic light emission element OLED.

The organic light emission element OLED can emit light by the drive current applied from the third transistor T3.

Although it is not shown in FIG. 3, a transistor being switched by a light emission signal can further be disposed between the first power line PL and the third transistor T3.

Figure 4:
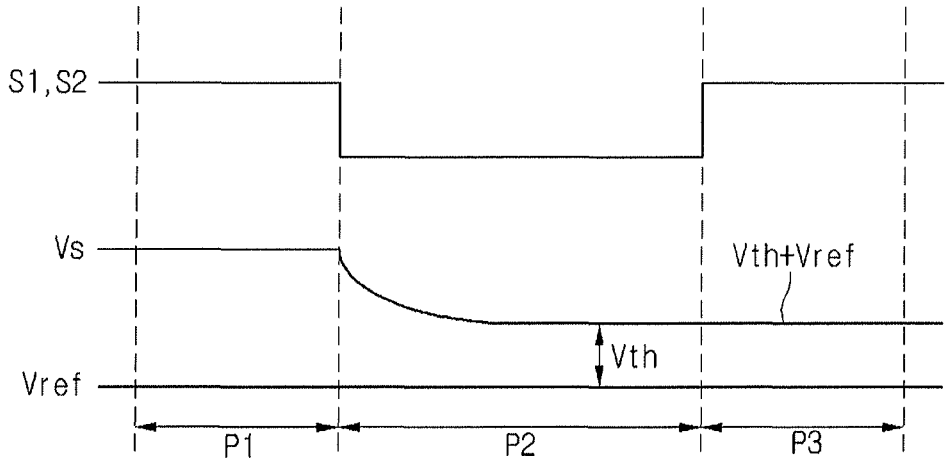
FIG. 4 is a waveform diagram illustrating signals used for detecting a sensing voltage.

Such a circuit configuration of the pixel region shown in FIG. 3 can be driven by signals with waveforms shown in FIG. 4.

As shown in FIG. 4, the circuit configuration within the pixel region can be driven according to three individual intervals.

A first interval P1 is a period used to charge the pre-charge data voltage Vpre into the load capacitor Cload. A second interval P2 corresponds to another period used to sense the threshold voltage Vth. A third interval P3 is still another period used to apply the sensed threshold voltage Vth to the exterior.

The operation of the circuit configuration of the pixel region will now be described in detail in each of the first through third intervals referring to FIGS. 5A through 5C.

<First Interval>

Figure 5A:
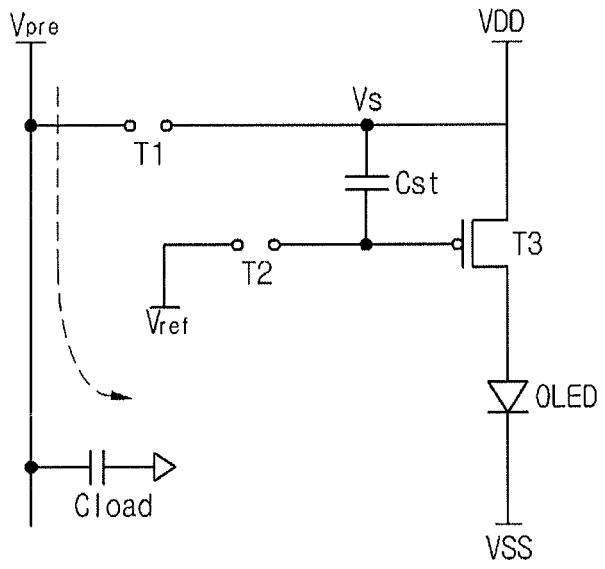
FIGS. 5A through 5C are circuit diagrams showing switching states of transistors when the pixel region is driven in time intervals.

As shown in FIG. 5A, the first and second scan signals S1 and S2 with a high level can be applied to the first and second scan lines GL and GL' in the first interval P1.

As such, the first and second transistor T1 and T2 can be turned-off by the first and second scan signals S1 and S2 having the high level. Also, the pre-charge data voltage Vpre can be charged into the load capacitor Cload.

<Second Interval>

Figure 5B:
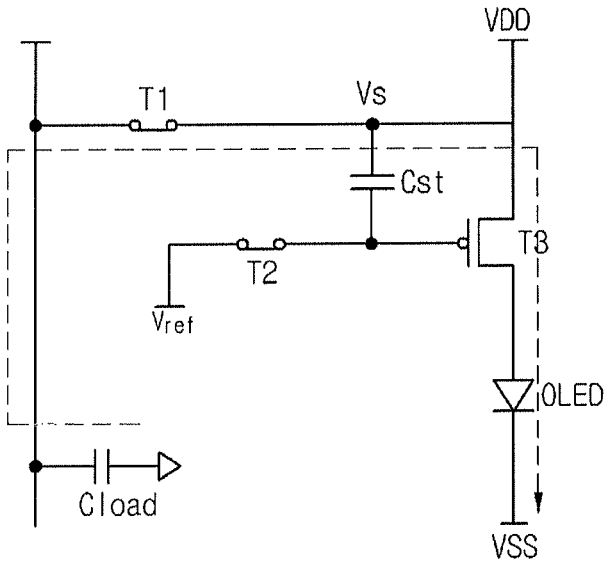

In the second interval P2, the first and second scan signals S1 and S2 having a low level can be applied to the first and second scan lines GL and GL', as shown in FIG. 5B.

The first and second scan signals S with the low level can enable the first and second transistors T1 and T2 to be turned-on. As such, the pre-charge data voltage Vpre charged into the load capacitor Cload can be charged into the first node through the first transistor T1, and the reference voltage Vref can be charged into the second node through the second transistor T2. In accordance therewith, a drive current can be applied from the third transistor T3 to the organic light emission element OLED.

During the second interval P1, the voltage Vs on the first node can be discharged to a threshold voltage of the third transistor T3. The threshold voltage Vth can be charged into the load capacitor Cload through the first transistor T1.

<Third Interval>

Figure 5C:
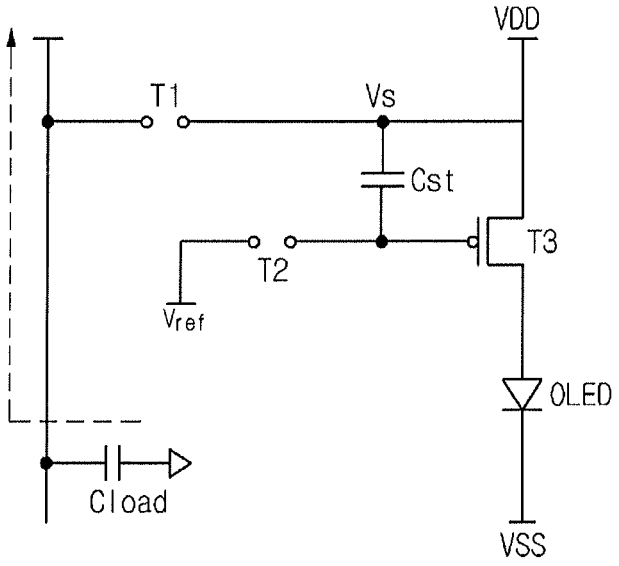

As shown in FIG. 5C, the first and second scan signals S1 and S2 with the high level can be applied to the first and second scan lines GL and GL' in the third interval P3.

The first and second scan signals S1 and S2 with the high level can force the first and second transistors T1 and T2 to be turned-off. Also, in the third interval P3, the threshold voltage Vth charged into the load capacitor Cload can be applied to the exterior through the data line DL as sensing information Sensing1.

In the present embodiment, such first through third intervals P1 through P3 can allow the sensing information Sensing1 including the threshold voltage Vth to be provided to the exterior.

Figure 6A:
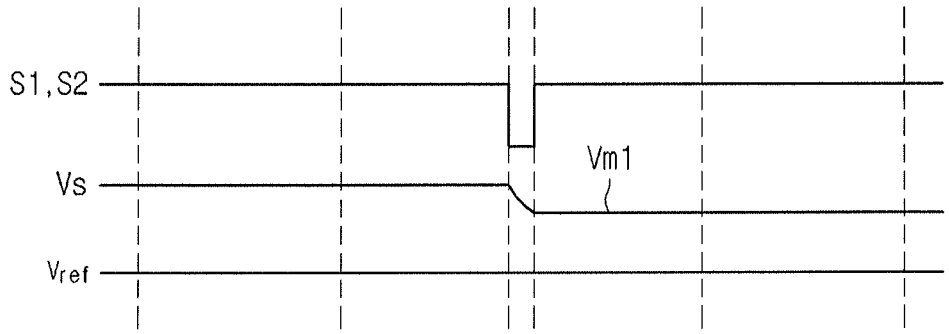
FIGS. 6A through 6C are waveform diagram illustrating an inclination calculation method for detecting mobility.
Figure 6B:
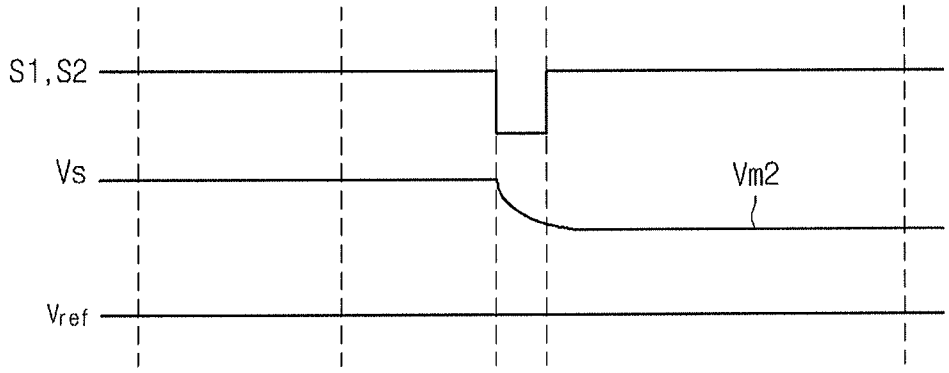
Figure 6C:
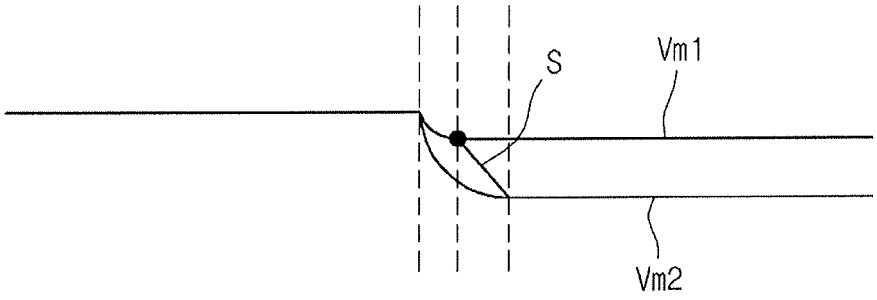

Moreover, the present embodiment being driven according to the first through third intervals P1 through P3 can allow the sensing information Sensing1 including mobility μ to be applied to the exterior, as shown in FIGS. 6A through 6C In other words, first sensing information including a first voltage Vm1 can be applied to the exterior for a first sensing interval, as shown in FIG. 6A. In a second interval second sensing information including a second voltage Vm2 can be applied to the exterior, as shown in FIG. 6B. It is explained that the first and second sensing information can be individually detected, but the present embodiment is not limited to this.

The second sensing interval can be set longer than the first sensing interval. In detail, the first and second sensing intervals can have the same start time point and different end time points. In this case, there exists a period from the end time point of the first sensing interval to the end time point of the second sensing interval can be called as "a mobility detection interval".

The first and second sensing information can be applied to the controller 30 through the data driver 50 of FIG. 1. As such, the controller 30 can calculate a slope S (or an inclination), which drops down from the first voltage Vm1 to the second voltage Vm2 in the mobility detection interval, on the basis of the first and second sensing information, i.e., the first and second voltage Vm1 and Vm2. Then, the controller 30 can obtain the mobility μ from the slope S. A mobility μ is varied with a slope S. In other words, the mobility μ is lower as the slope S gets smaller, and the mobility μ is higher as the slope S gets more larger. Furthermore, the controller 30 can control a gain value based on the calculated slope S. Such operation will be explained in detail through the description for the controller 30 of FIG. 8.

Figure 7:
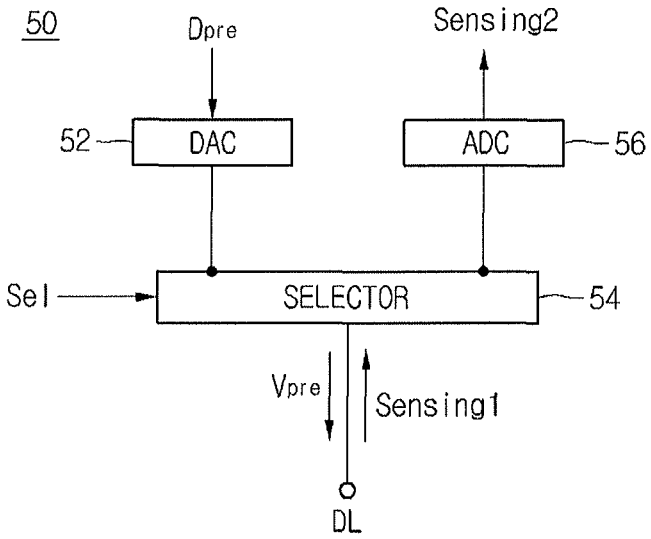
FIG. 7 is a block diagram schematically showing a data driver of FIG. 1.

As shown in FIG. 7, the data driver 50 can include a DAC (Digital-to-Analog Converter) 52, an ADC (Analog-to-Digital Converter) 56, and a selector 54.

The DAC 52 can generate the pre-charge data voltage Vpre or the data voltage V'data. To this end, the DAC 52 can convert either a pre-charge data signal Dpre corresponding to a digital signal or a data signal for displaying an image into a pre-charge data voltage Vpre or a data voltage V'data, which corresponds to an analog signal.

The ADC 56 can convert the sensing signal Sensing1 of an analog signal obtained from the pixel region P into the sensing information Sensing2 of a digital signal.

The selector 54 can electrically connect the data lines DL1~DLm of the organic light-emitting panel 10 to either the DAC 52 or the ADC 56. The selector 54 can be controlled by a selection signal Sel.

For example, the selector 54 can be controlled to electrically connect the data lines DL1~DLm to the DAC 52 in response to the selection signal Sel having a low level. The selector 54 can be controlled to electrically connect the data lines DL1~DLm to the ADC 56 in response to the selection signal having a high level.

The pre-charge data signals Dpre corresponding to the digital signals can be converted into the pre-charge data voltages Vpre corresponding to the analog signals by means of the DAC 52 in the first interval P1 of FIG. 4. Also, the selector 54 can be controlled to electrically connect the data lines DL1~DLm to the DAC 52 in response to the selection signal Sel having a low level. As such, the pre-charge data voltages Vpre can be applied from the DAC 52 to the respective pixel regions P through the respective data lines DL1~DLm. In accordance therewith, the pre-charge data voltages Vpre can be charged into the load capacitors Cload of the respective pixel regions P.

In the third interval P3 of FIG. 4, the sensing information Sensing1 with analog Signals, which are charged into the load capacitors Cload within the respective pixel regions P, can be applied to the selector 54 through the respective data lines DL1~DLm. The selector 54 can be controlled to electrically connect the data lines DL1~DLm to the ADC 56 in response to the selection signal Sel with the high level. As such, the sensing information Sensing1 of the analog signals can be applied to the ADC 56. Furthermore, the sensing information Sensing1 with the analog signals can be converted into sensing information Sensing2 with digital signals by the ADC 56. The converted sensing information Sensing2 including the digital signals can be applied to the controller 30 of FIG. 1.

Although it is not shown in FIG. 7, the data driver 50 can further include a shift register, a sampling circuit, first and second latches and so on, in order to process the data signals for displaying an image. Furthermore, the data driver 50 can include a buffer for buffering either the pre-charge data voltages Vpre with analog signals or the data voltages V'data with the analog signals.

Figure 8:
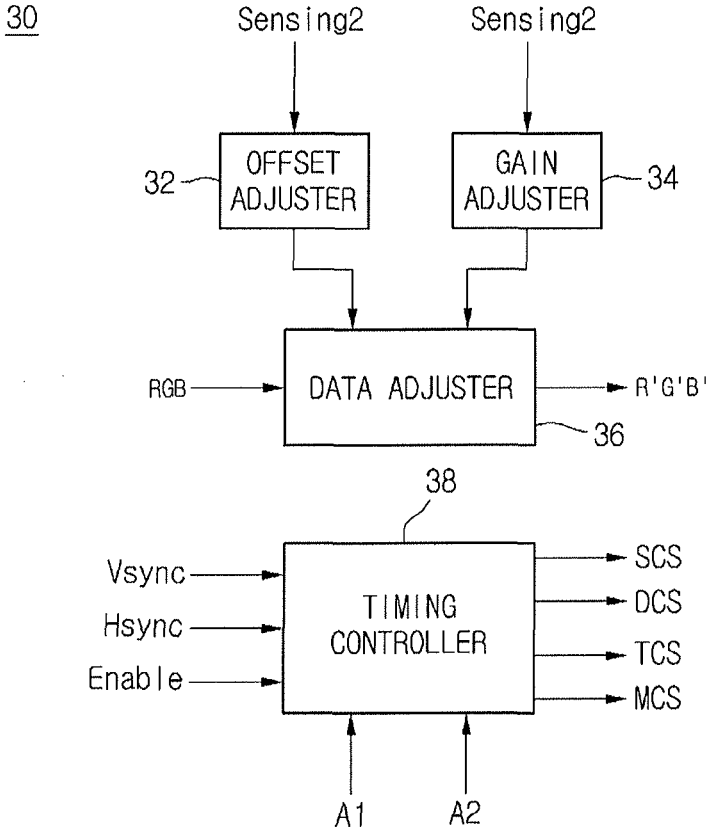
FIG. 8 is a block diagram schematically showing a controller of FIG. 1.

As shown in FIG. 8, the controller 30 can include an offset adjuster 32, a gain adjuster 34, a data adjuster 36 and a timing controller 38.

Figure 9:
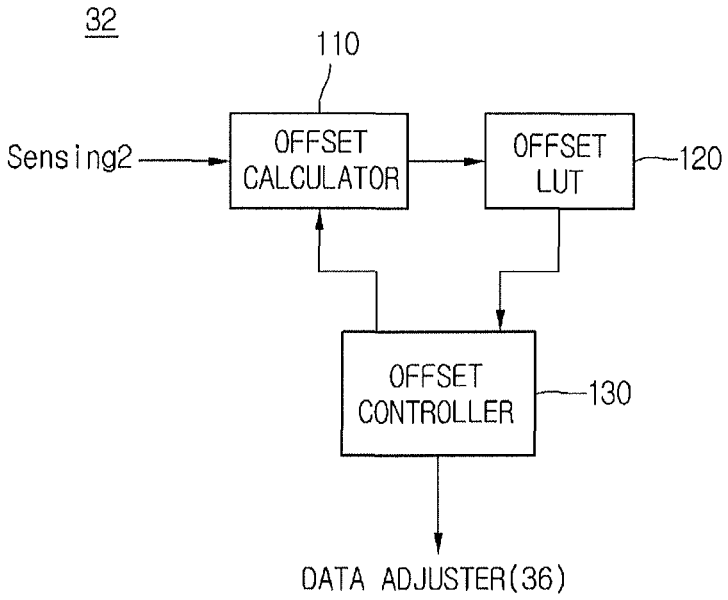
FIG. 9 is a block diagram showing an off-set adjuster of FIG. 8.

The offset adjuster 32 can include an offset calculator 110, an offset LUT (Look-Up table) 120, and an offset controller 130, as shown in FIG. 9.

The offset calculator 110 can receive the sensing information Sensing2 including the threshold voltages Vth, which are generated in the organic light-emitting panel 10 and transferred through the data driver 50. Also, the offset calculator 110 can obtain an offset value from the threshold voltage Vth, which is included in the sensing information Sensing2, under control of the offset adjuster 32.

The offset adjuster 110 of an embodiment can directly obtain the offset value from the threshold voltage Vth. Also, the offset calculator 110 can store the obtained offset value in the offset LUT 120.

Alternatively, in another embodiment, the offset calculator 110 can be connected to the offset LUT 120 into which offset information in accordance with a plurality of threshold voltages is stored in a table shape, unlike that shown in FIG. 9. In this case, the offset calculator 110 can read out an offset value corresponding to the threshold voltage Vth, which is included in the sensing information Sensing2, from the offset LUT 120 on the basis of the threshold voltage Vth of the sensing information Sensing2.

The sensing information Sensing1 generated in each of the pixel regions P within the organic light-emitting panel 10 of FIG. 1 is applied to the offset calculator 110. As such, the offset calculator 110 can calculate the offset values for all the pixel regions P. Also, the calculated offset values can be established or stored into the offset LUT 120 in such a manner as to correspond to the respective pixel regions P.

For instance, the offset value can be used to increase or decrease the data voltage for displaying an image. As such, the offset values corresponding to digital signals can separately increase or decrease according to the pixel regions P so that the modulated pixel data signals R', G' and B' for an image signal are suitably set for the respective pixels of pixel data signals R, G and B. Hereinafter, the pixel data signal R, G, and B is called as a first image signal, and the modulated pixel data signal R', G', and B' is called as a second image signal.

For convenience of explanation, the offset value can be explained in an analog signal shape. For example, an offset value of 0.5V or another offset value of −0.7 can be added to a data voltage of 5V. In this case, the modulated data voltage may be 5.5V or 4.3V.

A range of the offset value can be varied along a design specification of a designer, but it is not limited to this.

Consequently, the offset LUT 120 can store a single frame of offset values, but it is not limited.

Figure 10:
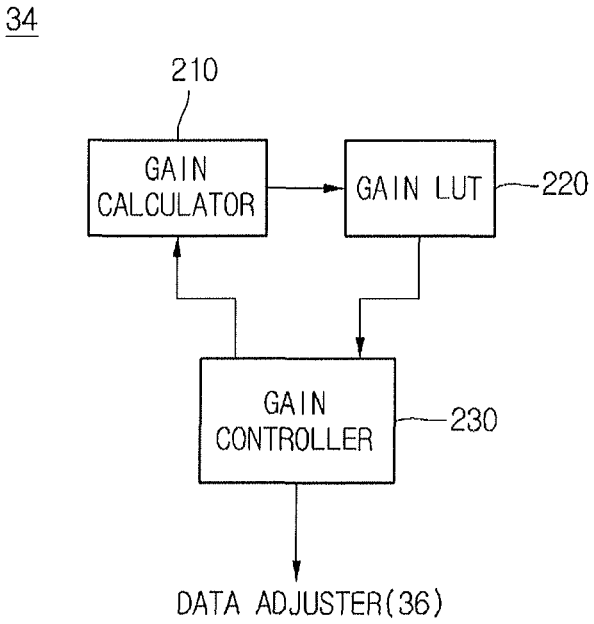
FIG. 10 is a block diagram showing a gain adjuster of FIG. 8.

Referring to FIG. 10, the gain adjuster 34 can include a gain calculator 210, a gain LUT 220 and a gain controller 230.

The gain calculator 210 can receive the first sensing information including the first voltage Vm1, which is generated for the first sensing interval as shown in FIG. 6A, and the second sensing information including the second voltage Vm2, which is generated for the second sensing interval as shown in FIG. 6B, from the organic light emitting panel 10 of FIG. 1. Also, the gain calculator 210 can calculate a slope S (or an inclination), which drops down from the first voltage Vm1 to the second voltage Vm2 in the mobility detection interval as shown in FIG. 6C, from the first and second voltages Vm1 and Vm2 under control of the gain controller 230.

Then, mobility μ can be estimated from the calculated slope S. If the slope S is gentle, the mobility μ may become lower. On the contrary, when the slope s is steep, the mobility μ may become higher.

The gain calculator 210 can directly obtain the gain value from the calculated slope S. The obtained gain value can be stored into the gain LUT 220 by means of the gain calculator 210.

In an embodiment, the controller 30 can adjust a gain value on the basis of the slope S.

As another embodiment, the gain calculator 210 can be connected to the gain LUT 220 into which gain information in accordance with a plurality of slopes S is stored in a table shape, unlike that shown in FIG. 10. In this case, the gain calculator 210 can calculate the slope S on the basis of the first and second voltages Vm1 and Vm2 each included in the first and second sensing information, and read out a gain value corresponding to the calculated slope S from another gain LUT 220.

The first and second sensing information including the first and second voltages Vm1 and Vm2, which are generated in each of the pixel regions P within the organic light-emitting panel 10 of FIG. 1, can be applied to the gain calculator 210. As such, the gain calculator 210 can calculate the gain values for all the pixel regions P. Also, the calculated gain values can be established or stored into the gain LUT 220 in such a manner as to correspond to the respective pixel regions P.

The gain value can be multiplied by the amplitude of the data voltage for displaying an image, later. In other words, the gain values corresponding to digital signals can be suitably set for the respective pixels and multiplied by the amplitudes of the data signals for the respective pixels.

For example, a data voltage of 5V can be multiplied by a gain value of 0.5 or a data voltage of 5V is multiplied by a gain value of 1.3.

A range of the gain value can be varied along a design specification of a designer, but it is not limited to this.

Consequently, the gain LUT 220 can store a single frame of gain information.

Referring to FIG. 8, the data adjuster 36 can adjust the image signal R', G' and B on the basis of the calculated offset information from the offset adjuster 32 and the gain information which is calculated in the gain adjuster 34.

For example, a single frame of offset information can be applied from the offset adjuster 32 to the data adjuster 36. As such, the data adjuster 36 can reflect the offset information into a first image signal R, G and B and output a second image signal R', G' and B'. The second image signal R', G' and B' is applied to the organic light-emitting panel 10 through the data driver 50. As such, an image being compensated for the threshold voltage Vth can be displayed. Thus, ununiformity of brightness does not generate.

For another example, a single frame of gain information can be applied from the gain adjuster 34 to the data adjuster 36. As such, the data adjuster 36 can reflect the gain information to a first image signal R, G and B and output a second image signal R', G' and B'. The second image signal R', G' and B' is applied to the organic light-emitting panel 10 through the data driver 50. As such, an image being compensated for the mobility μ can be displayed. In accordance therewith, ununiformity of brightness does not generate.

The present embodiment can reflect at least one of the offset information and the gain information to the image signal R, G and B.

As an embodiment, the offset information or the gain information can be calculated or updated every frame.

Alternatively, the offset information or the gain information can be calculated or updated every fixed frame periods. In this case, the fixed frame periods can become one of 5 frame periods, 10 frame periods and 20 frame periods, but it is not limited to these.

Meanwhile, the timing controller 38 can derive timing signals from a vertical synchronous signal Vsync, a horizontal synchronous signal Hsync and an enable signal. The timing signals can be used to drive the organic light-emitting panel 10. Also, the timing signals can include SCS and DCS. The SCS is scan control signals and the DCS is data control signals.

Also, the timing controller 38 can generate and output TCS and MCS using selection signals A1 and A2.

The TCS can become a control signal. The TCS can be used to control not only the sensing information Sensing1 to be obtained from each of pixel regions P but also the offset information or the gain information to be calculated.

The MCS can also become a control signal. The MCS can be used to control not only the image signal R, G and B to be compensated for the offset information or the gain information but also an image to be displayed by the compensated image signal R', G' and B'.

In accordance therewith, when the offset information or the gain information is calculated, all the components within the system can be controlled by the TCS. Also, all the components within the system can be controlled by the MCS when the image is displayed.

Although it is not shown in the drawings, the timing controller 38 can generate the selection signal, which is applied to the selector 54 of FIG. 7. However, the timing controller 38 is not limited to this.

The embodiment enables the compensation of the threshold voltage Vth of the pixel region P to be not performed within the pixel region P. Alternatively, in the embodiment, the sensing information Sensing1 about the threshold voltage Vth, of the drive transistor within the pixel region P is applied to the controller 30, the offset information used to compensate for the threshold voltage Vth is calculated by the controller 30 and reflected into the image signal R, G and B, and an image is display in the organic light-emitting panel 10 by the image signal reflected with the offset information. Therefore, the circuit configuration of the pixel region P can be simplified, and furthermore the aperture ratio of the pixel region P can be maximized.

Moreover, the embodiment can enable the sensing information Sensing1 including not only the threshold voltage of the drive transistor within the pixel region but also mobility μ to be detected. As such, the offset value and the gain information can be obtained from the sensing information Sensing1 and reflected to the image signal R, G and B. The image signal R', G' and B reflected with the offset value and the gain information is displayed on the organic light emitting panel 10. In this manner, both of the threshold voltage Vth and the mobility μ can be reflected to the image signal R, G and B. Therefore, more uniform brightness can be provided.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

The invention claimed is:

1. An organic light-emitting display device comprising:

an organic light-emitting panel comprising a plurality of pixel regions, each of the pixel regions being defined by a first scan line, a second scan line, and a data line crossing each other, and including an organic light emission element, a storage capacitor, a load capacitor connected to the data line, a first transistor connected to the first scan line, a second transistor connected to the second scan line, a drive transistor configured to drive the organic light emission element a first node connected to a drain electrode of the first transistor and a source electrode of the drive transistor, and a second node connected to a gate electrode of the drive transistor and a drain electrode of the second transistor, wherein the storage capacitor is disposed between and directly connected to the first node and the second node;

a controller configured to control a light emission of the organic light emission element within the pixel region during a display interval and sense at least one of a threshold voltage or a mobility of the drive transistor during a sensing interval; and a scan driver configured to simultaneously apply a first scan signal to the first scan line and a second scan signal to the second scan line, wherein during the display interval, the organic light emission element within the pixel region is light-emitted and the threshold voltage of the drive transistor is charged into the load capacitor, and wherein the sensing interval includes first and second sensing intervals which have the same start time point and different end time points, a period between the end time points of the first and second sensing intervals defining a mobility detection interval, the load capacitor is charged with a first voltage in the first sensing interval and a second voltage in the second sensing interval, during the sensing interval, the threshold voltage of the drive transistor is supplied from the load capacitor to the controller and the first and second voltages are sensed, the first and second voltages having slopes different from each other such that the mobility of the drive transistor are calculated based on the slopes of the first and second voltages in the mobility detection interval.

2. The organic light-emitting display device of claim 1, wherein the controller includes a gain adjuster configured to obtain the gain information from the first and second voltages and a data adjuster configured to reflect the gain information to a first image signal.

3. The organic light-emitting display device of claim 2, further comprising a data driver configured to apply one of a pre-charge data voltages and data voltages to the data line of the organic light-emitting panel, wherein the pre-charge data voltage is used for detecting the threshold voltage.

4. The organic light-emitting display device of claim 3, wherein the data driver includes:

a DAC configured to convert a pre-charge data signal and a second image signal, which each corresponds to digital signals, into one of the pre-charge data voltage and the data voltage which each corresponds to analog signals;

a ADC configured to convert a first sensing information including the threshold voltage and the first and second voltages, which each corresponds to the analog signals, into a second sensing information corresponding the digital signal; and a selector configured to selectively connect the data lines on the organic light-emitting panel to one of the DAC and the ADC.

5. The organic light-emitting display device of claim 2, wherein the slope is defined by a difference between the first and second sensing intervals.

6. The organic light-emitting display device of claim 1, wherein the controller includes:

an offset adjuster configured to calculate offset information on the basis of the threshold voltage and store the offset information; and a data adjuster configured to generate a second image signal by reflecting the offset information to a first image signal.

7. The organic light-emitting display device of claim 6, wherein the offset adjuster is configured to include an offset LUT into which the offset information in accordance with a plurality of threshold voltages is stored in a table, and obtain the offset information corresponding to the threshold voltage from the offset LUT.

* * * * *